US010892545B1

(12) United States Patent
Parsche

(10) Patent No.: US 10,892,545 B1
(45) Date of Patent: Jan. 12, 2021

(54) DEPLOYABLE DISK ANTENNA

(71) Applicant: Eagle Technology, LLC, Melbourne, FL (US)

(72) Inventor: Francis Parsche, Palm Bay, FL (US)

(73) Assignee: Eagle Technology, LLC, Melbourne, FL (US)

( * ) Notice: Subject to any disclaimer, the term of this patent is extended or adjusted under 35 U.S.C. 154(b) by 0 days.

(21) Appl. No.: 16/563,664

(22) Filed: Sep. 6, 2019

(51) Int. Cl.

| | |
|---|---|
| ***H01Q 1/00*** | (2006.01) |
| ***H01Q 1/10*** | (2006.01) |
| ***H01Q 1/36*** | (2006.01) |
| ***H01Q 1/48*** | (2006.01) |
| ***H01Q 1/12*** | (2006.01) |
| ***H01Q 1/50*** | (2006.01) |
| ***H01Q 1/28*** | (2006.01) |
| ***H01Q 1/27*** | (2006.01) |

(52) U.S. Cl.
CPC ..... *H01Q 1/36* (2013.01); *H01Q 1/12* (2013.01); *H01Q 1/1235* (2013.01); *H01Q 1/1242* (2013.01); *H01Q 1/27* (2013.01); *H01Q 1/288* (2013.01); *H01Q 1/48* (2013.01); *H01Q 1/50* (2013.01)

(58) Field of Classification Search
CPC ..... H01Q 9/0414; H01Q 1/10; H01Q 15/161; H01Q 15/20; H01Q 1/27; H01Q 1/1235; H01Q 1/1242; H01Q 1/288; H01Q 1/36; H01Q 1/48; H01Q 1/50; H01Q 1/12; E04H 12/182; E04H 12/085; E04H 12/10
See application file for complete search history.

(56) References Cited

U.S. PATENT DOCUMENTS

| | | | | |
|---|---|---|---|---|
| 4,295,141 A | | 10/1981 | Bogner | |
| 5,218,375 A | * | 6/1993 | Hillman | E04H 12/182 343/883 |
| 6,018,325 A | * | 1/2000 | Lundgren | E04H 12/16 343/878 |
| 6,028,570 A | * | 2/2000 | Gilger | H01Q 1/288 343/880 |
| 6,046,706 A | * | 4/2000 | Vargas | H01Q 1/1235 343/880 |

(Continued)

OTHER PUBLICATIONS

Guest, Simon D., "Deployable Structures: Concepts and Analysis," Disscertation submitted to the University of Cambridge for the Degree of Doctor of Philosophy, Corpus Christi College, May 1994.

(Continued)

*Primary Examiner* — Vibol Tan
(74) *Attorney, Agent, or Firm* — Fox Rothschild LLP; Robert J. Sacco; Carol E. Thorstad-Forsyth

(57) ABSTRACT

Disk antenna includes a plurality of conductive plates forming a stack aligned along a principal axis. The plates include a ground plane plate, a plurality of electrically active plates, and a drive plate disposed between the ground plane plate and the plurality of electrically active plates. A mast is configured to transition from a first condition in which the mast is compactly stowed, to a second condition in which the mast is deployed. Suspension members are configured to couple a radiating end of the mast to the plurality of electrically active plates. The plates are compactly stacked when the mast is in the first condition, and urged to distributed locations along the length of the mast in the second condition.

25 Claims, 8 Drawing Sheets

(56) References Cited

U.S. PATENT DOCUMENTS

| | | | | |
|---|---|---|---|---|
| 7,102,590 | B2 | 9/2006 | Regala | |
| 7,307,587 | B2 | 12/2007 | Eom et al. | |
| 7,966,777 | B2 * | 6/2011 | Douglas | E04H 12/182 52/118 |
| 8,661,744 | B2 * | 3/2014 | Keller | E04H 12/182 52/118 |
| 10,746,349 | B2 * | 8/2020 | Ghazanfari | F16M 11/28 |
| 2005/0275590 | A1 | 12/2005 | Eom et al. | |
| 2010/0295751 | A1 * | 11/2010 | Sheers | H01Q 1/10 343/901 |

OTHER PUBLICATIONS

Hansen, W.W., et al., "A New Principle in Directional Antenna Design," Proceedings of the Institute of Radio Engineers, vol. 26, No. 3, Mar. 1938.

"Characteristics of 5 to 35 Turn Axial Mode Helix Antenna", Electronics Research Laboratory, The Aerospace Research Corporation, El Segundo CA, report No. TR-77-200, Jun. 1, 1977.

Simon et al.: "Un Nouveau Type D'Aerien A Rayonnement Longitudinal", Departtement Recherches generales, Centre de Recherches techniques, Compagnie generale de T.S.F; 1953 pp. 183-193.

* cited by examiner

DEPLOYABLE DISK ANTENNA

BACKGROUND

Statement of the Technical Field

The technical field of this disclosure concerns antenna systems, and more particularly methods and systems for implementing extremely compact high gain antennas which are deployable.

DESCRIPTION OF THE RELATED ART

Antennas are needed for a wide variety of applications, including space-based applications. When used in space-based applications, it is often necessary for an antenna system to be stowed compactly to facilitate transport into space. The same antenna must then be able to deploy automatically to its full size when it arrives at an on-orbit location. Relatively high gain is a necessary capability of certain types of communications systems, including satellite-based communication systems. Such high gain can be challenging to facilitate when the size of the antenna is constrained. For example, there is a growing need for high gain antenna systems which can be employed in CubeSats. CubeSats are a class of nanosatellites which are built to a defined set of standard dimensions, such as 1U, 2U or 3U where U or Unit refers to a standard satellite size of 10 cm×10 cm×10 cm. Providing a high-gain deployable antenna as described herein can become even more challenging when operating in the UHF frequency range. This is mainly due to the larger physical wavelength of signals in the UHF frequency range, which often necessitate physically larger antenna structures.

Axial mode helix antennas, which may have a diameter of approximately ⅓ wavelength at the design frequency of the antenna, and carry a traveling wave current flow, may be used for satellite flight antennas. The helix is known to provide a ready means of pre-launch compaction and later space deployment because the radiating element can function as a spring. Still, such a space deployable helix has some unwanted shortcomings: 1) the elastic nature of the spring may result in un-damped motions for which spacecraft reaction wheels must contend; 2) lower frequency helical spring elements may be costly to fabricate as they essentially comprise a relatively large relaxed spring that must be furnace tempered; 3) the traveling wave mode of helix operation is not efficient in gain for length performance compared to Brown Woodward theoretical gain length limits; 4) the axial velocity component of current along a constant winding pitch helix may have difficulty matching the axial velocity of the advancing wave; 5) a single helix cannot provide simultaneous dual polarizations 6) the single axial mode helix is undesirable for linear polarization; and 7) the helix has a driving point resistance near 130 ohms requiring matching.

Parabolic reflector antennas may have an aperture efficiency near 60%. Yet in space the parabola presents deployment risks. These risks are due to the overall complexity of the structure, the behavior of lubricants in space (which are complex), the presence of many moving parts, re-radiation of passive intermodulation, and costs associated with parabola.

So, while helix antennas and parabola reflector antennas have sometimes been used to facilitate the need for deployable antenna systems, their challenges are many. Further, these antenna designs can be inadequate to provide the necessary amount of gain—particularly under conditions where the physical size of the antenna is constrained by a particular set of design requirements.

SUMMARY

This document concerns a disk antenna which includes a plurality of plates forming a stack aligned along a principal axis. Each plate includes a major conductive surface extending in directions transverse to the principal axis. The plurality of plates include a ground plane plate, a plurality of electrically active plates, and a drive plate disposed between the ground plane plate and the plurality of electrically active plates. A mast is configured to transition from a first condition in which the mast is compactly stowed, to a second condition in which the mast is deployed such that a length of the mast along the principal axis is increased as compared to the first condition. The mast can be comprised of a highly conductive material or a low-loss dielectric material. One or more suspension members are configured to directly or indirectly couple the mast to the plurality of electrically active plates. The plates are configured to be compactly stacked when the mast is in the first condition, and are urged by the suspension members to a plurality of distributed locations along the length of the mast in the second condition.

The drive plate of the disk antenna functions as an antenna feed that is configured to couple radio frequency (RF) energy between the disk antenna and an RF transmission line. The electrically active plates have various shapes which can include a polygon and a closed curved shape. In some scenarios, a spacing between adjacent ones of the electrically active plates when the mast is in the second condition can be varied along the principal axis in a direction from the ground plane plate to a radiating end of the antenna mast distal from the ground plane plate. In some scenarios, the electrically active plates have a circular profile. Further, a diameter of the electrically active plates can be varied in a direction along the principal axis from the ground plane plate to a radiating end of the mast distal from the ground plane plate.

According to one aspect, a spacing between adjacent ones of the electrically active plates when the mast is in the second condition is $0.2\lambda$, where $\lambda$ is a wavelength of a design frequency at which the disk antenna is to operate. Further, the ground plane plate may be comprised of two conductive ground plane layers, spaced apart by a predetermined distance by one or more inner conductive elements which electrically connect the two or more conductive ground plane layers to define an RF trap.

The mast is comprised of one or more elements selected from the group consisting of a spoolable extensible member (SEM), and a plurality of telescoping sections. The one or more suspension members are flexible tensile members secured at a first end to a carrier plate disposed at a radiating end of the mast, distal from the ground plate. The one or more flexible tensile members are configured to determine the plurality of distributed locations of the plates when the mast is in the second condition.

In some scenarios, one or more of the ground plane plate, the plurality of electrically active plates, and the drive plate include a principal aperture through which the mast extends when the mast is in the second condition. In such scenarios, one or more of the ground plane plate, the plurality of electrically active plates, and the drive plate may be conductively isolated from the mast or may be conductively coupled to the mast.

The invention also concerns a method for deploying a disk antenna. The method involves arranging a plurality of plates to form a stack aligned along a principal axis, where each plate comprises a major conductive surface extending in directions transverse to the principal axis. The method also involves arranging the plurality of plates in the stack to include a drive plate disposed between a ground plane plate and a plurality of electrically active plates. The method can continue by controlling deployment of the disk antenna. Such deployment can involve transitioning a mast from a first condition in which the mast is compactly stowed, to a second condition in which a length of the mast along the principal axis is increased as compared to the first condition. One or more suspension members which are directly or indirectly coupled to the mast, are then used to urge the plurality of electrically active plates, in response to the transitioning. This step involves urging the electrically active plates from a stowed configuration in which the plates are compactly stacked, to a deployed configuration in which a spacing between adjacent ones of the electrically active plates is increased. Consequently, the electrically active plates are distributed at predetermined spaced apart locations along an elongated length of the mast in the second condition.

BRIEF DESCRIPTION OF THE DRAWINGS

This disclosure is facilitated by reference to the following drawing figures, in which like numerals represent like items throughout the figures, and in which.

DETAILED DESCRIPTION

Figure 1:
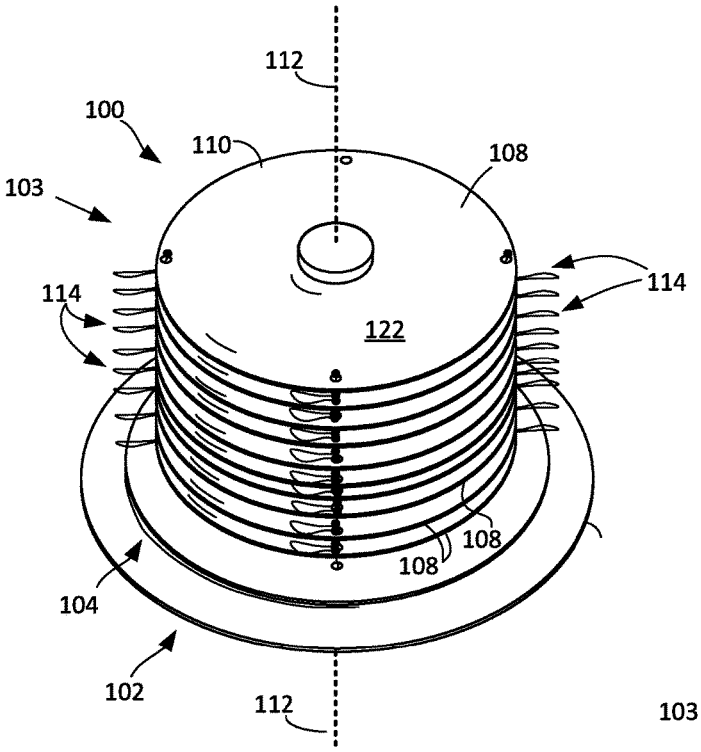
FIG. 1 is a drawing that is useful for understanding a configuration of an antenna in a compacted condition.

It will be readily understood that the solution described herein and illustrated in the appended figures could involve a wide variety of different configurations. Thus, the following more detailed description, as represented in the figures, is not intended to limit the scope of the present disclosure, but is merely representative of certain implementations in various different scenarios. While the various aspects are presented in the drawings, the drawings are not necessarily drawn to scale unless specifically indicated.

Figure 2:
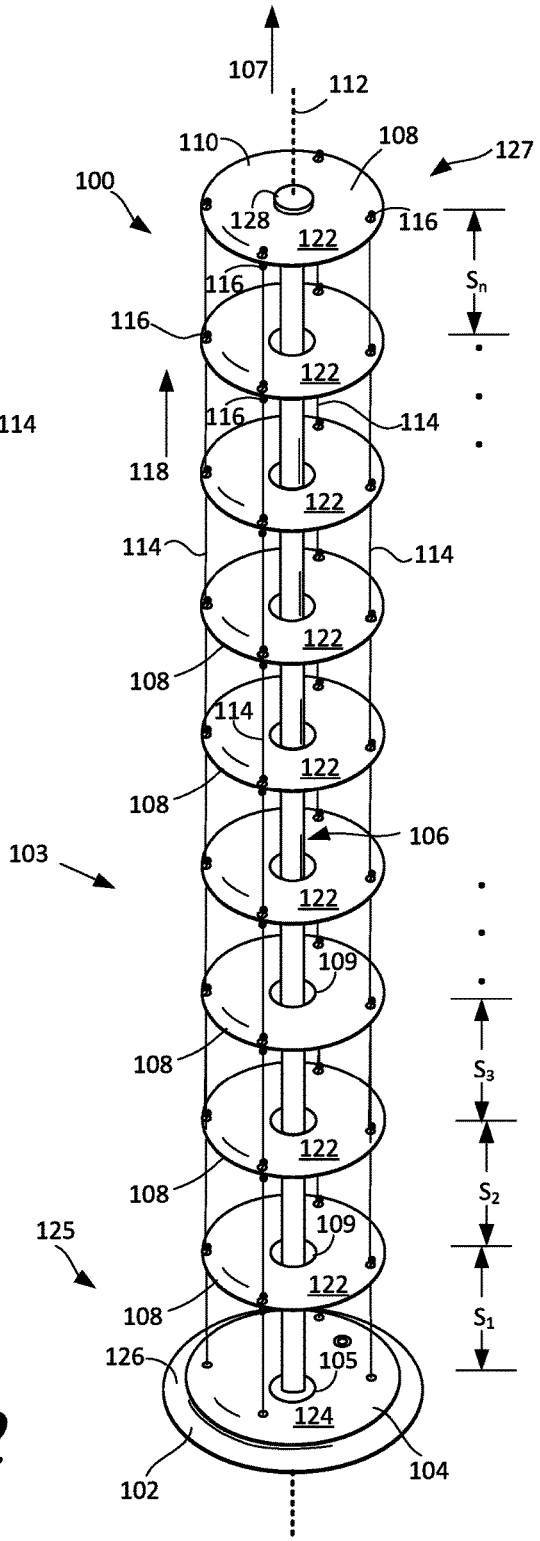
FIG. 2 is a drawing that is useful for understanding a configuration of the antenna in a deployed condition.
Figure 3:
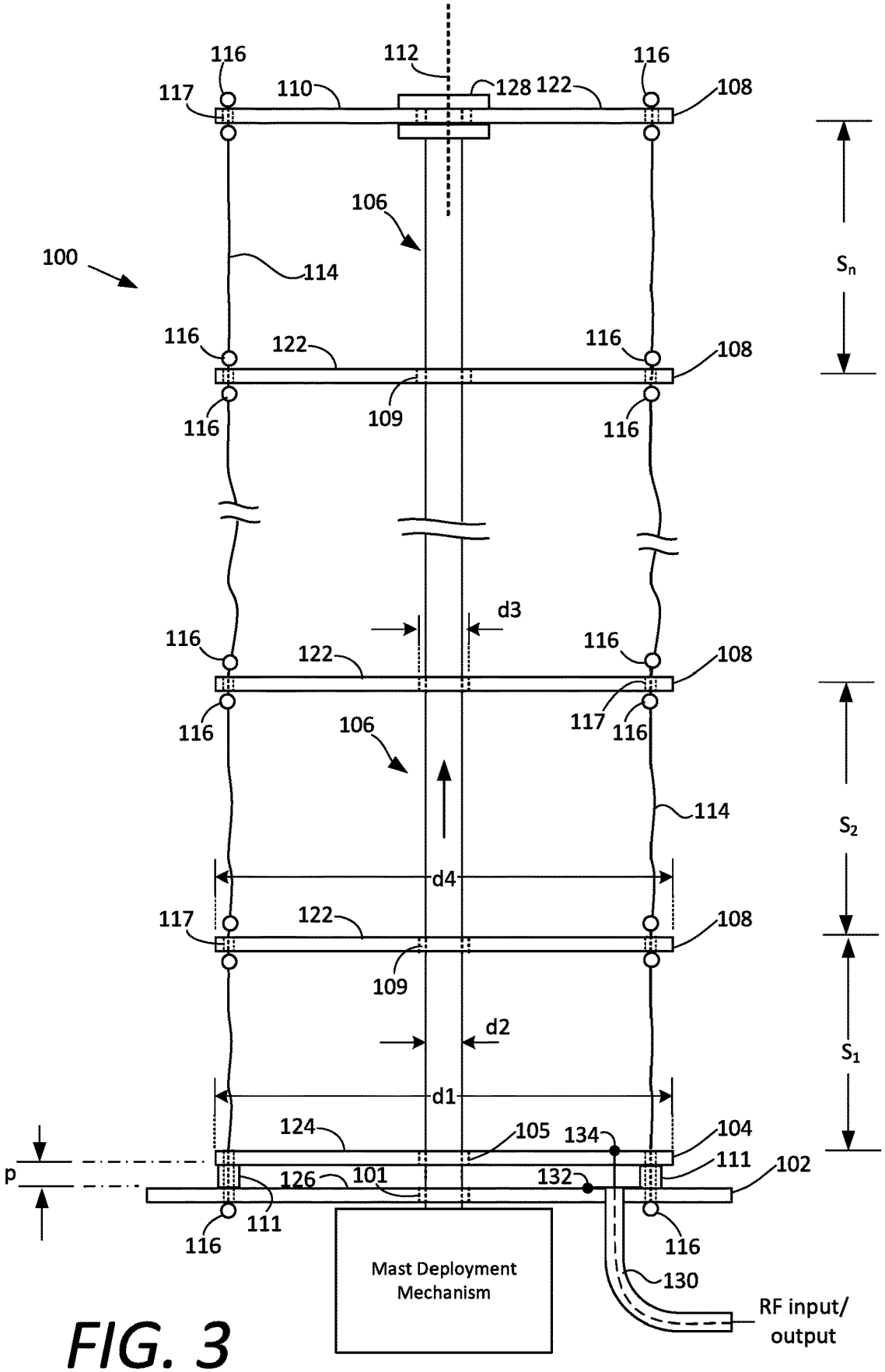
FIG. 3 is a schematic drawing that is useful for understanding certain features of the antenna.

Certain aspects of a deployable antenna system described herein may be understood with reference to FIGS. 1-3. The disk antenna 100 is comprised of a plurality of plates which are arranged to form a stack 103. The plurality of plates include a ground plane plate 102, a plurality of electrically active plates 108, and a drive plate 104 that is disposed between the ground plane plate and the plurality of electrically active plates. The plates in the stack are aligned along a principal axis 112, and each plate comprises a major conductive surface 122, 124, 126 extending in directions transverse to the principal axis. Each of these major conductive surfaces can be planar or substantially planar such that the major conductive surface in each case will extend in a plane that perpendicular or substantially perpendicular to the principal axis 112. The planar conductive surfaces are comprised of a highly conductive material such as copper, aluminum, gold or silver.

According to one aspect, each plate 102, 104, 108 can have a principal aperture 101, 105, 109. In some scenarios, these apertures can be advantageously disposed in alignment with the principal axis 112. In the example implementation shown in FIGS. 1 and 2, the resulting plates 102, 104, 108 are annular disk elements.

The disk antenna 100 also includes a mast 106. According to one aspect, the mast 106 can extend along the principal axis so that it passes through the principal aperture 101, 105, 109 of plates 102, 104, 108. The mast is configured to transition from a first condition shown in FIG. 1 in which the mast is compactly stowed, to a second condition shown in FIG. 2 in which a length of the mast along the principal axis 112 is increased as compared to the first condition. In some implementations, the mast 106 can be comprised of a conductive material. In other implementations, the mast 106 cab be comprised of a dielectric material. Both implementations can provide acceptable performance provided that the material type is accounted for in the antenna overall design. As explained below in further detail, the mast can be conductively coupled to the plates 102, 104, 108 or can be conductively isolated from such plates.

A carrier plate 110 is provided at a tip end 128 of mast 106, spaced apart from the ground plane plate 102. The carrier plate 110 is preferentially cantilevered or rigidly attached to the mast 106 to keep the suspended disks from tilting relative the mast. One or more suspension members 114 can be attached to the carrier plate. The one or more suspension members are flexible tensile members and as such may be comprised of cords, tapes or similar constructs. In some scenarios, the suspension members can be comprised of synthetic fibers, including but not limited to fibers formed of polymer based materials such as polyamide, polyester, aramid (e.g. Kevlar®), and so on. In other scenarios the suspension members can be comprised of a tape or film formed of a polymer-based material such as polyamide (e.g., Kapton®). In still other scenarios, the suspension members can be comprised of a material such as graphite fiber.

In the scenario shown in FIGS. 1 and 2, the carrier plate 110 is an electrically active plate 108 that is mounted to the tip end 128. However, the solution is not limited in this regard and in some scenarios the carrier plate 110 can simply comprise a rigid attachment point where the one or more suspension members can be secured to the tip end. In the example shown, the individual suspension members are secured at locations on the carrier plate which are spaced at approximately 90 increments around the principal axis 112. However, it should be understood that a greater or lesser number of suspension members 114 can be used.

The suspension members 114 are configured to provide one or more mechanical couplings or tensile links which directly or indirectly couple the plurality of electrically active plates 108 to the tip end 128 of mast 106. As such, the suspension members are secured at a first end to the carrier plate 110. In some scenarios, a second end of each suspension member 114 can be secured to the ground plane plate 102 and/or the drive plate 104. Intermediate of these two opposing ends, the electrically active plates 108 are secured to the suspension members at spaced intervals along the length of the one or more suspension members. As such, the suspension members are configured to determine the plurality of distributed locations of the plates when the mast is in the second condition.

The electrically active plates 108 can be secured to the suspension members by any suitable means. In the example shown in FIGS. 1-3, the suspension members 114 pass through small apertures 117 that are provided in plates 102, 104 and 108. The position of the electrically active plates 108 along the length of each suspension member is fixed by ferrules 116 that are attached to the suspension members and disposed on opposing sides of each plate. The exact manner in which the electrically active plates are attached at intervals along the length of each suspension members is not critical. Thus, it will be understood that attachment configurations other than that shown in FIGS. 1-3 are possible. For example, in some scenarios the suspension members 114 can be knotted or tied to studs at each electrically active plate 108 to facilitate attachment. In other scenarios, clips can be used to secure the electrically active plates to the suspension members.

Each of the suspension members can be a continuous element as shown in FIG. 3 such that one continuous length extends from the carrier plate to ground plane plate. However, this configuration is not critical. For example, in other scenarios, each suspension member 114 can be comprised of a plurality of separate or individual segments. In such a scenario, one segment of an extension member will extend between each adjacent pair of electrically active plates in the stack.

In certain implementations described herein, the electrically active plates 108 are configured to be compactly stacked when the mast 106 is in the first condition. When in this condition the suspension members 114 are slack as shown in FIG. 1. The mast 106 extends or elongates in direction 118 to facilitate a transition from the first condition shown in FIG. 1 to the second condition shown in FIG. 2. As this transition occurs, the electrically active plates 108 are urged by the suspension members to a plurality of distributed locations along the elongated length of the mast in the second condition. Consequently, deployment of the mast to the condition shown in FIG. 2 has the effect of increasing a spacing between adjacent ones of the electrically active plates along the length of the mast. When the mast is fully extended, each pair of adjacent electrically active plates 108 is spaced by a distance $S_n$ where n is an integer value. A first distance S1 can comprise a distance between the drive plate 104 and the electrically active plate 108 that is most proximal to the drive plate. The remaining $S_2 \ldots S_n$ refer to spaces between pairs of electrically active plates 108.

In some implementations, all of the $S_n$ spacings described above can be equal. For example, computer modeling has shown that acceptable performance can be obtained where each of the $S_n$ spacings can correspond to approximately $0.2\lambda$ at the operating frequency. However, in other scenarios slightly different spacings can be provided between different pairs of plates for improved performance. For example, it can be advantageous from a performance standpoint to arrange the plates so that the electrically active plates which are proximal to the ground plane plate are more closely spaced as compared to those plates that are distal from the ground plane plate. Computer modeling can be used to optimize such spacings. In general, the optimization techniques applied to determine such spacings can involve matching the wave phase to the disk current. Configurations involving such alternative spacings will be described below in further detail.

In the disk antenna 100, the drive plate 104 is an antenna feed element which serves to excite the antenna and couple radio frequency (RF) energy between the antenna and an RF transmission line 130. The drive plate 104 can be supported on the ground plane plate using a plurality of rigid dielectric posts 111. The rigid dielectric posts space the drive plate a predetermined distance p from the major conductive surface 126 defined by the ground plane plate 102. As an alternative to the rigid dielectric posts 111, the space between the drive plate and the ground plane plate can be maintained by a suitable low-loss dielectric material.

The stack of electrically active plates 108 provides a lens-like effect to increase disk antenna 100 directivity. In this regard, the electrically active plates 108 facilitate three operating stages: 1) the capture of the radiated fields from the circular drive plate 104; 2) the conveyance of the captured radiated fields along the axis of the disk antenna 100, and; 3) the release the electromagnetic fields at the distal radiating end of the antenna. The capture and release is advantageously accomplished without an abrupt bump in wave velocity which could cause unwanted standing waves along the antenna axis. The disk antenna 100 is shown in FIGS. 1 and 2 as having nine (9) electrically active plates 108. However, it should be understood that the number of active plates 108 included in a particular implementation of the disk antenna 100 may vary. Fewer active plates 108 will reduce the gain of disk antenna 100 and more active plates will increase the gain of the disk antenna 100.

In the implementation shown in FIGS. 1 and 2, the plates shown all have a circular disk-like shape. However, it should be understood that implementations of the solution are not limited in this respect. The outer peripheral shape of one or more of the ground plane plate 102 and the electrically active plates 108 can be a closed curved shape such as a circle, an oval or an ellipse. In other scenarios, the peripheral shape of each plate can be a polygon such as a triangle, a quadrilateral, a pentagon, an octagon, and so on.

Certain plate shapes (as defined by an outer peripheral edge(s) of each plate) can offer advantages that can improve performance. For example, if a drive plate 104 is formed with a square profile, with half wavelength edges, then the four edges of the drive plate 104 would function as a four element slot dipole in array. In such a scenario, each drive plate edge could be considered an antenna element, advantageously causing the disk antenna 100 to have approximately 1.5 dBi more gain than a circular shape drive plate 104 plate embodiment of the disk antenna 100. Further, a drive plate 104 having a rectangular configuration with unequal length edges can advantageously permit the synthesis of circularly polarized radiation with only a single drive probe (e.g. electrical conductor 134). Such an arrangement can advantageously avoid the need for an external hybrid power divider. In effect, the unequal length edges of the drive plate can provide +45 degree leading and −45 degree lagging phases from off center frequency resonances and the "quadrature phasing condition" that synthesizes circular polarization from an array. In some scenarios, different plate shapes may be mixed along the length of the principal axis 112. Tradeoffs with plate shape include ease of fabrication, size/area, means of polarization synthesis, directive gain and other factors.

The ground plane plate 102, the plurality of electrically active plates 108, and the drive plate 104 can be of the same or different dimensions. The exact dimensions chosen each plate 102, 104, 108 in a particular implementation will be based on various design considerations and performance requirements. Consider the scenario shown in FIG. 1 in which the ground plane plate 102, the electrically active plates 108, and the drive plate 104 all have a circular or annular configuration. The ground plane plate 102 is not a resonant structure and therefore its diameter is not critical. The main tradeoff in choosing the diameter of the ground plane plate 102 involves choosing between backlobe amplitude and physical size of the antenna. A ground plane plate 102 with a larger diameter will reduce the amplitude or gain associated with one or more backlobes produced by disk antenna 100. Conversely, a ground plate 100 with a relatively smaller diameter will increase the gain or amplitude associated with such backlobes. In some scenarios, the ground plane plate 102 may be substituted for by an electrically conductive closed cylinder/circular waveguide cavity, a truncated cone/conical horn, a parabola or other structures.

A drive plate 104 having an annular configuration as shown in FIG. 1 is a resonant structure. Accordingly, the diameter of the drive plate is advantageously selected for a specific frequency of operation. In some scenarios, a suitable outer diameter d1 of drive plate 104 can be selected to be in the range of 0.4λ to 0.6λ, where λ is the wavelength corresponding to operational frequency at which the antenna is designed to operate. A diameter d2 of the mast 106 can impact upon a preferred diameter selected for the drive plate 104. In general, a mast having a larger diameter will require a larger drive plate 104 diameter, and a mast 106 having a smaller diameter can facilitate a smaller drive plate 104 diameter.

The mast 106 can be configured so that it will make electrical contact with the drive plate 104, or so that it will not make contact with the drive plate 104. Both configurations can provide satisfactory results with regard to antenna performance. The presence of dielectrics, such as spacers disposed between the plates and/or between the mast and the plates, can have an effect upon the diameter used for a particular drive plate implementation. Further, it will be understood that fine tuning/trimming of the antenna can necessitate further modifications to the diameter of the drive plate 104.

In some scenarios, the electrically active plates 108 within the stack can all be configured to have an equal inner diameter d3 and equal outer diameter d4. However, the solution is not limited in this regard and in some scenarios the electrically active plates 108 can have different diameters. Similarly, the spacings $S_1$, $S_2$, . . . $S_n$ between electrically active plates included in the stack can all be the same in some implementations, but in other implementations can vary along the length of the stack. Electrically active plates 108 of non-constant diameters and/or spacings can be useful for purposes of reducing gain associated with sidelobes in the disk antenna 100.

One antenna configuration with such non-constant spacing for achieving reduced gain antenna sidelobes would involve electrically active plates 108 arranged so as to provide a smaller plate spacing at the feed end 125 of the antenna, and larger plate spacings toward the radiating end 127 of the disk antenna 100. Another implementation for achieving reduced gain antenna sidelobes would involve use of non-constant diameters for the electrically active plates 108. In such a scenario, smaller diameter plates would be positioned at the radiating end 127 of the disk antenna 100, opposed from the feed, larger diameter plates in a middle portion of the antenna between the feed and the radiating end of the antenna, and smaller diameter plates again near the feed end 125. In such scenarios, a profile of the antenna would have an elongated ovoid shape extending along the principal axis.

As noted above, the antenna can be implemented with or without conductive electrical contact between a center mast 106 formed of a conductive material and any one or all of the ground plane plate 102, the drive plate 104, and plurality of electrically active plates 108. When conductive electrical contact is made between a center mast 106 formed of a conductive material and any one or all of the ground plane plate 102, the drive plate 104, and plurality of electrically active plates 108 plate, then dimensions of the plates are modified to maintain electrical outcome.

In space applications the ground plane plate 102, the drive plate 104, and the electrically active plates 108 are preferentially in conductive electrical contact with mast 106. This arrangement is useful in order to avoid the space effects of electrical charge accumulation, corona discharge, multipaction, arcing etc. This plate conductive electrical contact may be accomplished by metal fiber brushes, leaf springs, graphite shoes or other means. In terrestrial embodiments or when otherwise warranted the electrically active plates 108, the drive plate 104, and the carrier plate 110 need not be in conductive electrical contact with the mast 106.

The size of the drive plate 104 scales linearly and reciprocally with frequency, meaning increasing a diameter of drive plate 104 by say 2 percent reduces frequency by 2 percent and reducing a diameter of drive plate 104 increases frequency by 2 percent. As can be appreciated, the manufacture of metal or printed circuit board plates is an advanced art with the required tolerances easily accomplished. Spacing between the plurality of electrically active plates is electrically forgiving. Spacing between the ground plane and the drive plate 104 is maintained by spacers or rigid dielectric posts 111 and does not vary pre or post deployment. Thus the disk antenna 100 may be practically implemented at frequencies including VHF into microwaves.

Figure 4:
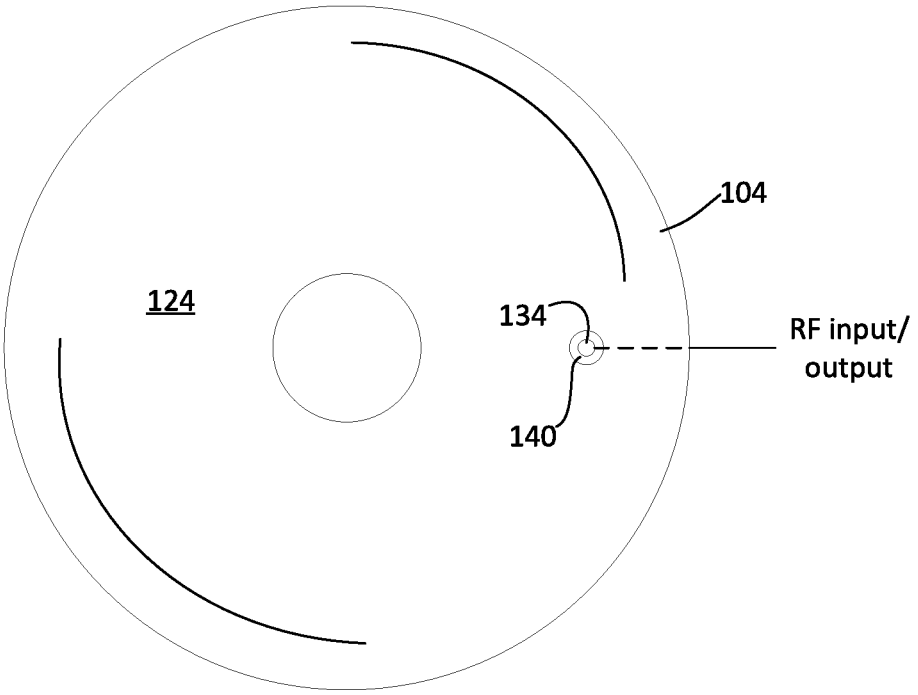
FIG. 4 is a drawing that is useful for understanding feed configuration of the antenna for linearly polarized radio frequency signals.
Figure 5:
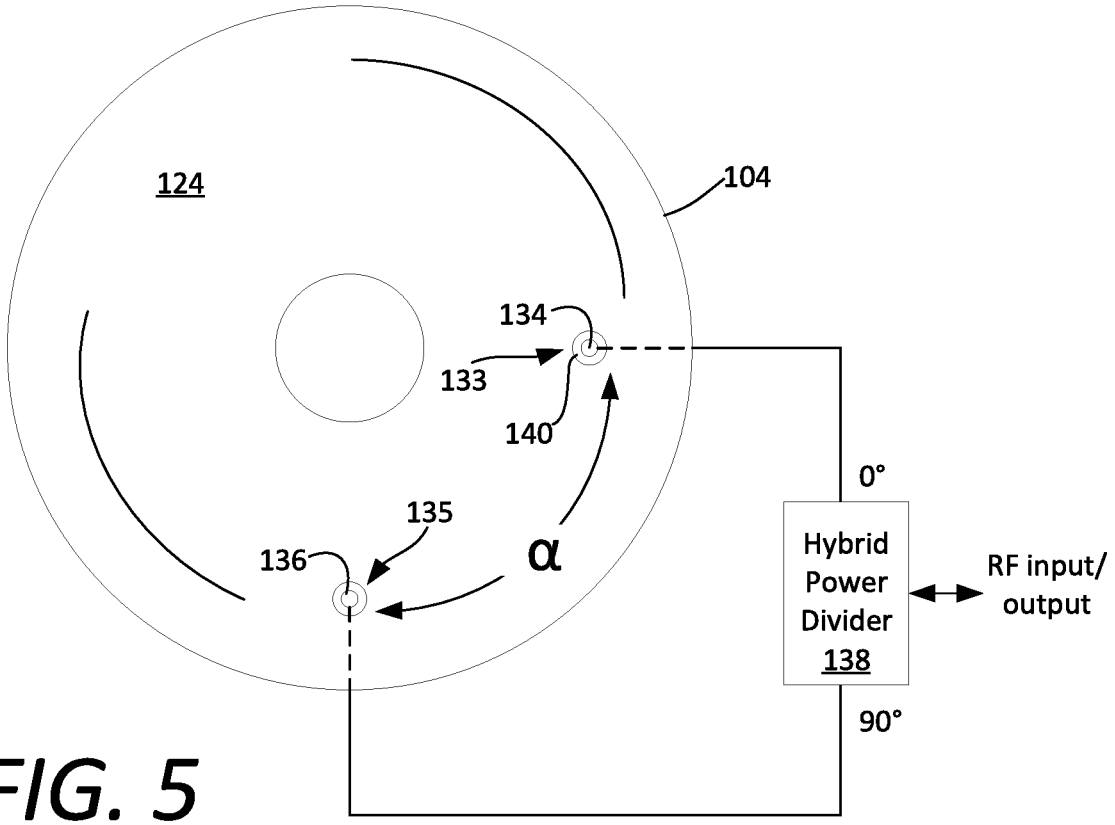
FIG. 5 is a drawing that is useful for understanding a feed configuration of the antenna for circularly polarized radio frequency signals.

As shown in FIGS. 3 and 4, a first conductor 132 of the RF transmission line 130 can be electrically connected to the ground plane plate 102 and a second conductor 134 can be electrically coupled to the drive plate 104. These two connections define a first electrical coupling 133 to the drive plate which is sufficient to facilitate antenna operation with signals that have a linear polarization. In other scenarios, operation of the antenna with signals that have a circular polarization can be facilitated by adding a second electrical coupling 135 to the drive plate as shown in FIG. 5. To facilitate the circular polarization, the physical location of this second electrical coupling 135 will have an angular offset a on the face of the drive plate 104 relative to the first electrical coupling 134. For example, in a scenario where the antenna feed is configured to include a 90° hybrid power divider 138, the value of a can be 90°.

Figure 6:
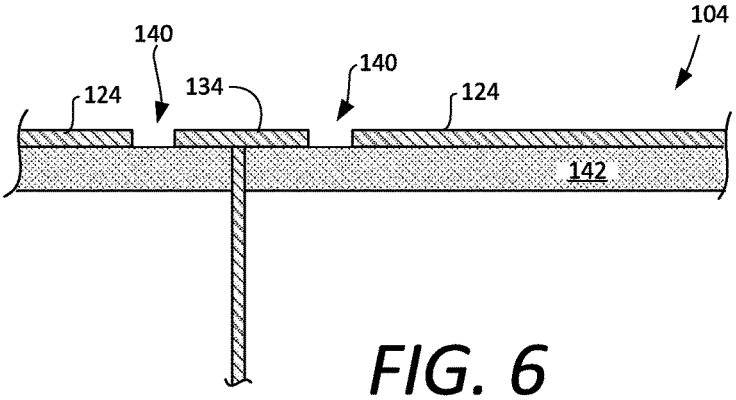
FIG. 6 is a drawing that is useful for understanding a capacitive feed pin arrangement which can be used to facilitate an antenna feed.

According to one aspect, each of the first and second electrical couplings 133, 135 can be comprised of a capacitive coupling. This concept is illustrated in FIG. 6 which shows that the first electrical conductor 134 can be separated or spaced apart from the major conductive surface 124 by a continuous gap 140 which ensures that the first electrical conductor 134 is galvanically isolated from the major conductive surface 124. Consequently, the first electrical conductor 134 is capacitively coupled to the major conductive surface 124. A similar arrangement can be employed with electrical conductor 136 comprising second electrical coupling 135. It can also be observed in FIG. 6 that a drive plate 104 can in some scenarios be comprised of a low-loss dielectric support layer 142 on which the major conductive surface 124 is disposed. The low-loss dielectric support layer can be comprised of any suitable dielectric material such as a fiber reinforced polymer and/or a ceramic material.

Figure 7:
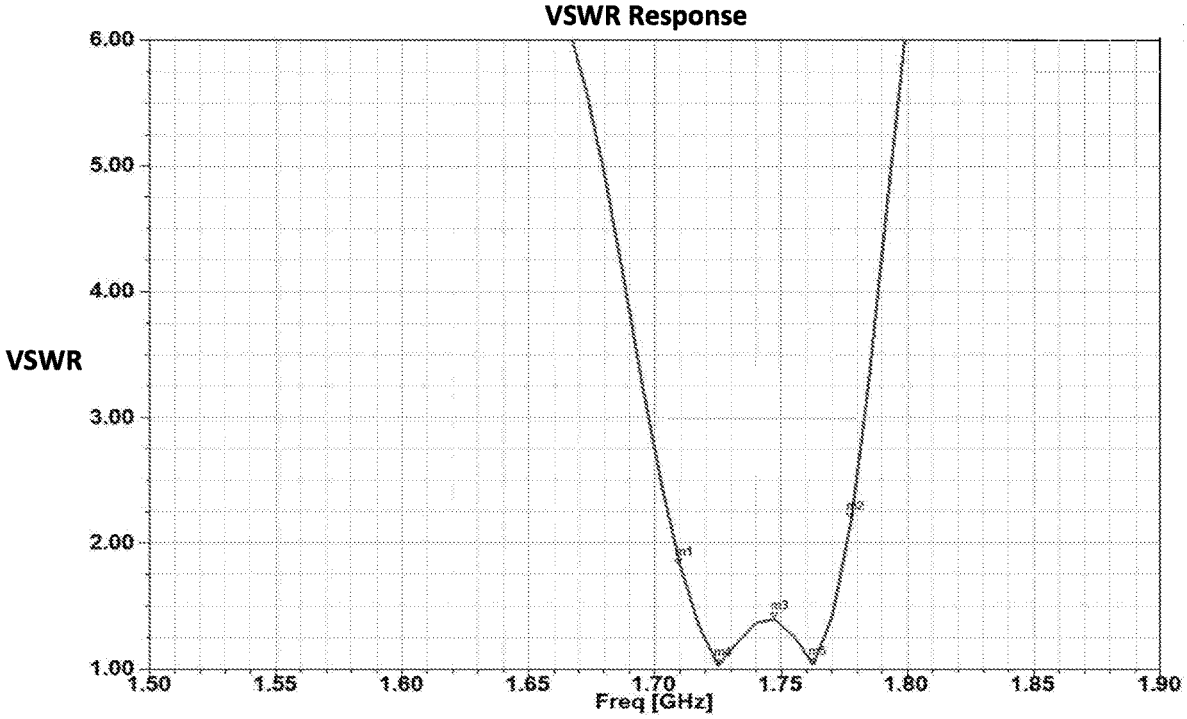
FIG. 7 is a drawing that is useful for understanding a VSWR response which can be achieved with the antenna.

An advantage of the capacitive feed coupling described herein is that it provides a convenient method for tuning and broadening a bandwidth of the disk antenna 100. FIG. 7 is a voltage standing wave ratio (VSWR) plot of the input of disk antenna 100, constructed in accordance with the specifications set forth below in Table 1. The plot illustrates that the antenna can advantageously exhibit a fourth order Chebyschev polynomial response. In this regard it may be noted that the antenna has two points of resonance with a rippled bandpass response that has the effect of increasing bandwidth. This is a distinct improvement over conventional quadratic response antennas that do not include the advantageous feed mechanism described herein. A first resonance point indicated by marker m4 in FIG. 7 will correspond to a resonant frequency associated with the drive plate 104. The second resonance point or frequency as indicated by marker m5 is determined in accordance with the capacitance developed at first and second electrical couplings 133, 135 as described above. These two resonance points can be selected to achieve a selected center frequency for the antenna (as indicated by marker m3), a passband ripple amplitude, and an associated VSWR and gain operating bandwidth. Advantageously, many to most bandwidth requirements can be met by trading passband ripple level and the separation between resonance points.

Figure 8A:
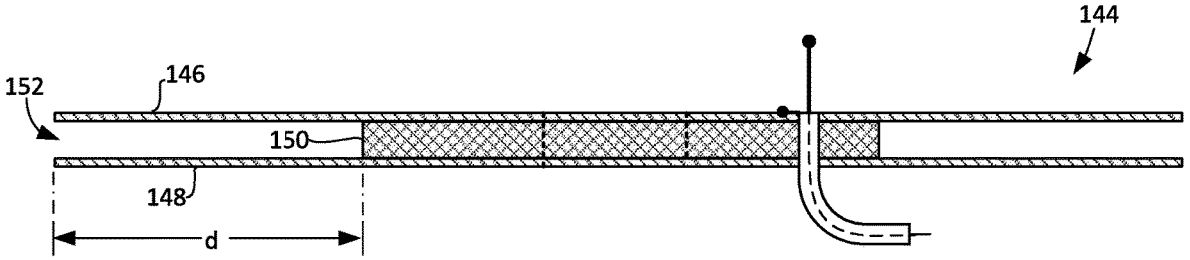
FIGS. 8A and 8B are a series of drawings that are useful for understanding a configuration for a ground plane plate which incorporates a radio frequency trap into a ground plane of the antenna.
Figure 8B:
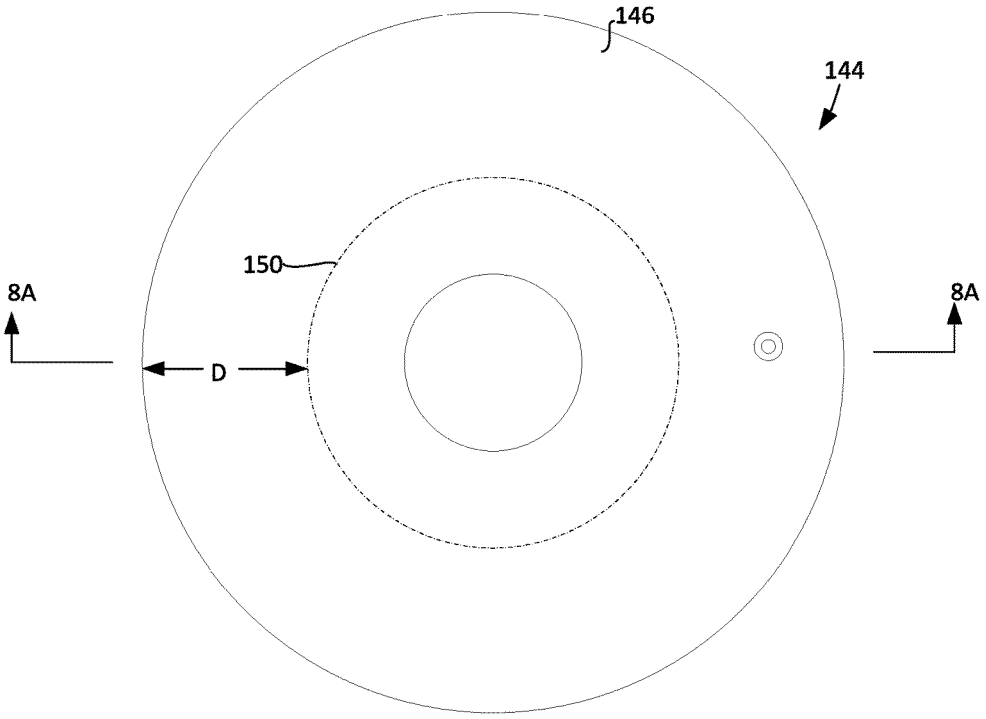

The disk antenna 100 can produce significant gain in a boresight direction 107 aligned with the principal axis 112. However, the disk antenna 100 can also potentially produce a certain amount of backfire radiation direction opposing the boresight direction. In order to reduce such backfire radiation, the ground plane plate 102 can in some scenarios be comprised of two or more major conductive planar surfaces which are arranged to form an RF trap. An example of such an arrangement is illustrated in FIGS. 8A-8B which show a ground plane plate 144 comprising two major conductive surfaces 146, 148. The two major conductive surfaces are electrically connected by a conductive inner structure 150. The conductive inner structure 150 can also function to maintain a space between the two major conductive surfaces. The conductive inner structure can be an annular ring-like structure as shown in FIG. 8A-8B or can be comprised of a plurality of conductive metal vias which extend between the two major conductive surfaces to form a similar annular ring-like structure. The resulting overall structure of the ground plane plate 144 can comprise a current choke slot 152 around a periphery of the ground plane plate 144. A depth D of this choke slot from the outer periphery of the ground plane plate 144 to the outer periphery of the conductive inner structure can in some scenarios be 0.25λ, where λ is the wavelength of the frequency at which the antenna is designed to operate.

Masts which are suitable for use with the antenna solution described herein can include a wide variety of extendable mast types which are well known in the art. For example, FIGS. 1-3 show a scenario in which a mast 106 is comprised of a spoolable extensible member (SEM). SEMs are well-known in the art and therefore will not be described here in detail. However, it will be appreciated that an SEM can comprise any of a variety of deployable structure types that can be flattened and stowed on a spool for stowage, but when deployed or unspooled will exhibit beam-like structural characteristics whereby they become stiff and capable of carrying bending and column loads.

SEM deployable structures come in a wide variety of different configurations. For example, some conventional SEMs can include a slit-tube (which is sometimes referred to as a Storable Tubular Extendible Members (STEM)), Triangular Rollable and Collapsible (TRAC) masts, Collapsible Tubular Masts (CTM), and so on. In the example shown in FIGS. 1 and 2 deployment of the SEM can be facilitated by a conventional mast deployment mechanism (not shown). Within the mast deployment mechanism, the SEM is typically disposed on a spool which is rotated by a motor. The rotation of the spool dispenses the SEM through a slot, after which the SEM will conform to its rigid deployed state as it extends from the ground plane plate.

Other types of deployable masts can also be used to facilitate the solution disclosed herein. For example in some scenarios, the mast 106 can be a telescoping arrangement comprised of a plurality of tubular sections which are nested together when in the stowed or compact condition, and which extend substantially end to end when in the extended or deployed condition. Still other possibilities include inflatable masts, and masts which have a pantograph configuration.

Figure 9:
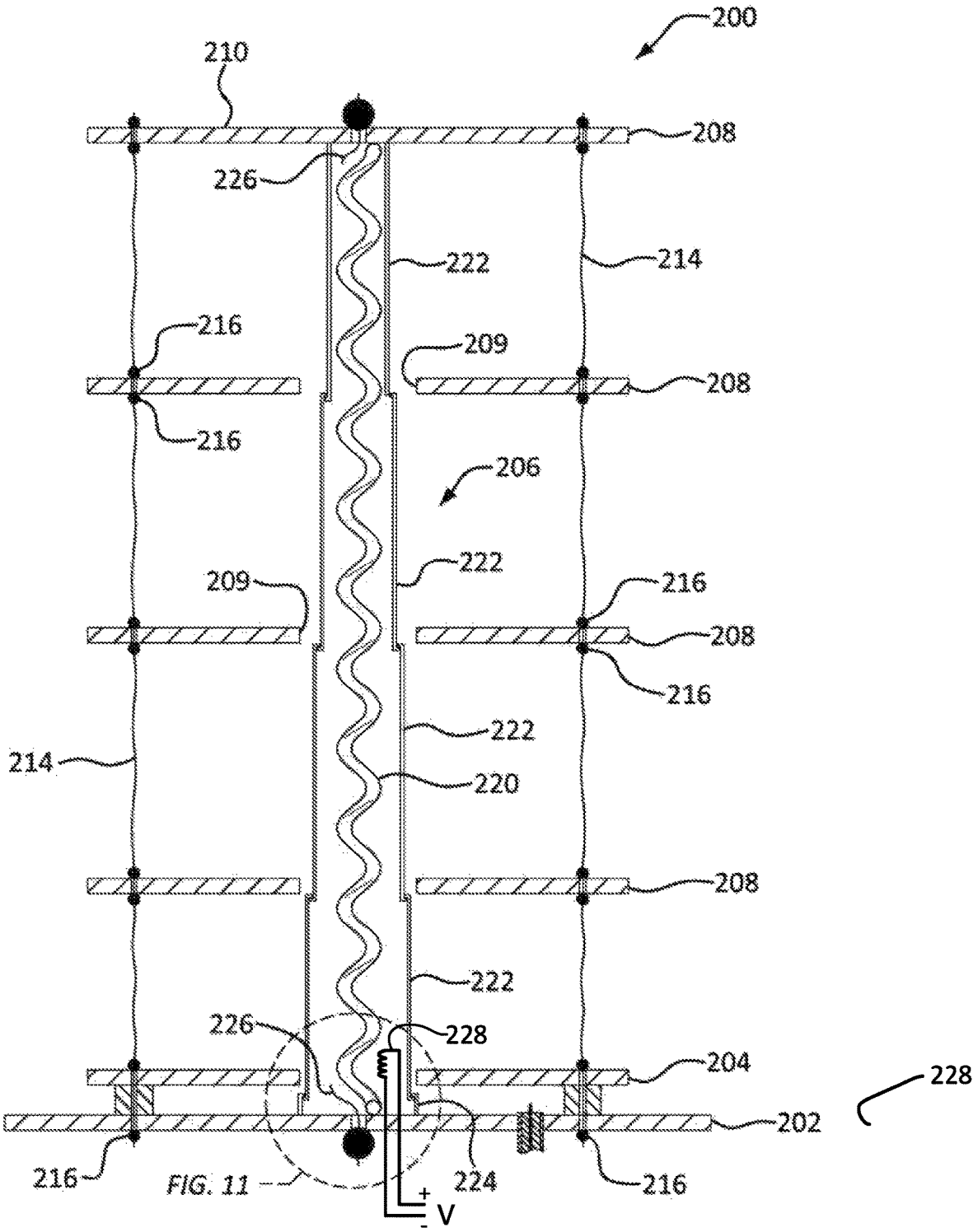
FIG. 9 is a drawing that is useful for understanding an implementation of an antenna solution which incorporates a telescopic type of mast in an extended configuration.
Figure 10:
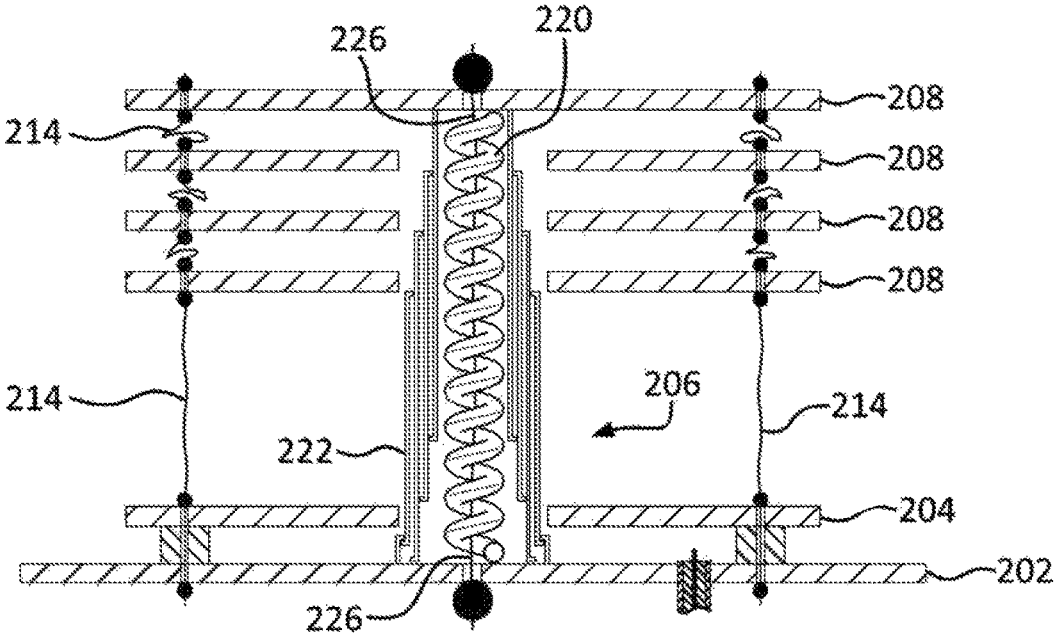
FIG. 10 is a drawing that is useful for understanding the antenna in FIG. 9 with the telescopic type of mast in a compact stowed configuration.
Figure 11:
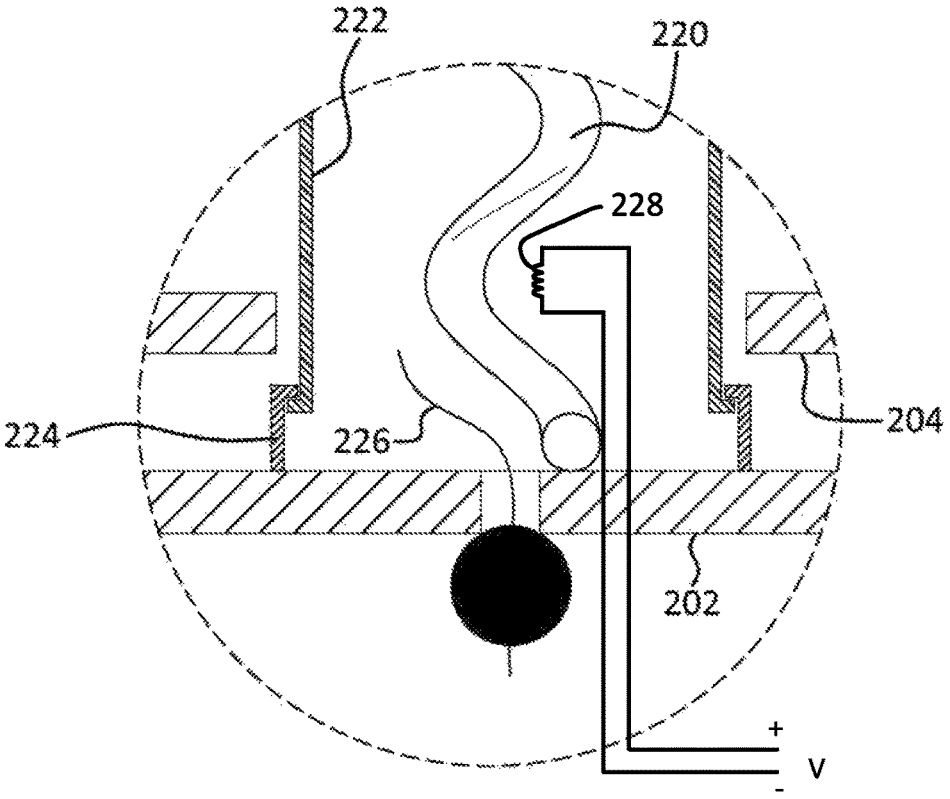
FIG. 11 is an enlarged view of a portion of FIG. 9.

A disk antenna 200 shown in FIG. 9-11 is similar to the disk antenna 100 except that a telescoping mast 206 is used in this implementation rather than an SEM type mast. The antenna includes a ground plane plate 202, a drive plate 204, and a plurality of electrically active plates 208 including a carrier plate 210. The electrically active plates 108 are suspended on suspension members 214, and are maintained in position along the length of the suspension members by the use of ferules 216. The mast 206 is comprised of a base section 224, and a plurality of tubular sections 222 which are elongated and extend through a principal aperture 209 in each plate. The tubular sections 222 are nested together when the mast is in the stowed or compact first condition shown in FIG. 10, and extend substantially end to end when the mast 206 is in the extended or deployed second condition shown in FIG. 9.

In the mast used for antenna 200, extension of the mast 206 is facilitated by a resilient member 220 which may be a spring. The resilient member is configured to urge or bias the tubular sections to the condition shown in FIG. 9. To maintain the antenna in the compact first condition shown in FIG. 10, a cord 226 can extend from the carrier plate 210 to the ground plane plate 202. For example, the cord can extend through a hollow center of the mast 206 to secure the carrier plate 210 to the ground plane plate 202. The cord is attached to both the carrier plate 210 and the ground plane plate 202 and its length is chosen so that the mast 206 is prevented from extending when the antenna is in the first condition shown in FIG. 10. In this condition, the cord is maintained under tension. When the antenna is to be transitioned from the compact first condition to its deployed condition (second condition) shown in FIG. 9, the tension provided by the cord 226 is released. This can be accomplished by any suitable means. For example, in some implementations, a heater element 228 can be used to melt or sever the cord 226. The heater element can be controlled by application of a voltage V at the time when the heater cord is to be severed.

Table 1 provides details of an example implementation of a prototype disk antenna which is useful for understanding the invention. The disk antenna in this example was built and tested in an anechoic chamber for operation at a center frequency of 1625 Mhz. The solution is not limited to an antenna having the particular dimensions described in Table 1. Instead, Table 1 merely presents one example of an antenna which is useful for understanding the inventive concepts presented herein. The design may be varied to facilitate frequency of operation, sidelobe level, driving impedance, backlobe level, height, width, spacing plate geometry, and so on. Table 1 physical dimensions are presented in dimensions of wavelength to aid scaling of the disk antenna 100 for other frequencies.

TABLE 1

| Parameter | Value | Comment |
|---|---|---|
| λ | The free space wavelength at the operating frequency | |
| Total number of plates | 17 | Including all plate types: ground plane, driven, and parasitic. |
| Plate shape | All plates were circular in this instance | |
| Total length of disk antenna 100 | 3.0λ | Value does not include the accessory hybrid power divider attached via cabling. |
| Largest disk antenna 100 diameter | 0.824λ | This is the ground plane 102 diameter |
| Mast 106 construction | Conductive metallic | May be a deployable mast or fixed tube |
| Mast 106 outer diameter | 0.034λ | |
| Ground plane 102 construction | 6061-T6 aluminum plate | |
| Ground plane plate 102 diameter | 0.824λ | This parameter sets backlobe level |
| Ground plane plate 102 thickness | 0.0085λ | |
| Drive plate 104 material | Thin FR4 printed circuit board | May also be sheet metal |
| Drive plate 104 outer diameter | 0.529λ | Approximately the first Bessel zero of the wavelength divided by pi. The Bessel function is of the first kind |
| Drive plate 104 thickness | 0.00440λ | Including dielectric |
| Drive plate 104 copper layer spacing from ground plane plate 102 | 0.0357λ | Adjacent face to adjacent distance, not center to center |
| Electrically active plate 108 outer diameter | 0.327λ | |
| Electrically active plates 108 thickness | 0.0085λ | |
| Spacing $S_1$ between electrically active plate 108 and copper layer of drive plate 104 | 0.190λ | Adjacent surface to adjacent surface |
| Carrier plate 110 outer diameter | 0.327λ | |
| Carrier plate 110 thickness | 0.0085λ | |
| Number of electrical conductor 134 feed probes | 2 | Mechanically spaced 0 and 90 degrees around the antenna axis |
| Electrical conductor 134/antenna port excitation | Equal amplitude, −90 and 0 degree relative phases | Excites circular polarization |
| Electrical conductor 134/feed probe locations | 0.112λ | Measured as radial distance from antenna center axis |
| Electrical conductor 134/feed probe construction | SMA panel mount connector screwed to ground plane 102 | Connector pin solders to drive plate 104 |
| Hybrid power divider | Anaren 30055 | Commercial stripline, −90 and 0 degree phase port excitations |
| Plate static charge drainage | Conductive brushes | |

In the antenna of Table 1, the drive plate 104 was selected to have a diameter of 0.529λ. In this regard it may be noted that a 0.529λ diameter circular drive plate 104 diameter corresponds closely to the lowest Bessel function zero at the antenna's operating wavelength divided by π, d=0.529λ/π. The prototype antenna described in Table 1 includes the use of electrically active plates 108 having a constant diameter throughout of 0.327 wavelengths.

The physical prototype described in Table 1 used an accessory 3 dB 0, 90 degree hybrid type power divider connected with phase matched/equal length coaxial cables to the electrical conductor 134 feed probes/antenna ports. As explained above, linear polarization is available by eliminating the hybrid and driving only one port.

The spacing p between the ground plane plate 102 and the drive plate 104 is the predominant parameter that sets the bandwidth of disk antenna 100. More spacing increases voltage standing wave ratio (VSWR) and realized gain bandwidth, less spacing decreases VSWR and realized gain bandwidth. The 0.0357λ ground plane 102 to drive plate 104 spacing was an initial design iteration; more ground plane 102 to drive plate 104 spacing for more disk antenna 100 bandwidth are certainly practical.

In the example shown in Table 1, conductive brushes (not shown) were provided such that a conductive electrical connection was realized between the mast 106 and the plates 102, 104, 108. The purpose of the brushes was to drain any static charges that could accumulate on ungrounded/isolated structures in space environment. However, it should be understood that the solution described herein is also operable without conductive electrical contact between the mast 106 and the plates 102, 104, 108. In such "floating" embodiments the principal apertures 101, 105, 109 cause the plates to be 102, 104, 108 to be conductively isolated annular ring structures. Both configurations are equally effective. To drain static charge in scenarios where the plates are electrically floating/annular ring embodiments, the suspension members 114 may be slightly electrically conductive fibers. Examples of materials which can be used for such slightly electrically conductive fibers include graphite and/or other materials with similar levels of conductivity.

Table 2 provides measured electrical results from the Table 1 prototype:

It may be noted in Table 2 that the first sidelobe level was 13 dB down from the main lobe, which is consistent with the maximum gain "Hansen Woodward Condition", as described in the paper: Hansen, W. W., and J. R. Woodward, "A New Principle In Directional Antenna Design", March 1938, Proceeding of The Institute Of Radio Engineers (IRE) 26, pp 333-345. Electrically active plates 108 of non-constant diameters and spacings can facilitate sidelobes which are suppressed even further than the −13 dB level of Hansen Woodward arrays.

When set up for linear polarization the measured polarization axial ratio was 28 dB, meaning that the horizontal polarization component was 28 dB down from the vertical polarization component. However, it should be noted that all polarizations are practical from the disk antenna 100: single linear polarization, dual linear polarization, circular polarization of either sense, and dual circular polarization.

A comparison of the example antenna in Table 1 relative to a conventional axial mode helix antenna is presented in Table 3. In the comparison, the representative axial mode helix gain was taken from FIG. 16 of the paper "Characteristics Of 5 to 35 Turn Axial Mode Helix Antenna", Electronics Research Laboratory, The Aerospace Research Corporation, El Segundo Calif., report number TR-77-200, 1 Jun. 1977.

TABLE 2

Measured Performance Results From The Table 1 Antenna

| Parameter | Result | Discussion |
|---|---|---|
| Realized gain | 15.8 dBic | dBic units are decibels with respect to isotropic, right hand circular polarization. Realized gain means all losses are included: conductor, dielectric VSWR etc. |
| 3 dB beamwidth | 28 degrees | |
| First sidelobe amplitude | 13 dB down | |
| Nominal impedance at antenna ports | 50 ohms | |
| VSWR at antenna ports, midband | 1.14 to 1 at antenna port 1<br>1.10 to 1 at antenna port 2 | Hybrid power divider removed temporarily. |
| Antenna port to port isolation at midband | 22 dB | |
| Polarization | Right hand circular | Cabling may be changed to obtain linear, left hand circular and simultaneous dual polarizations. |
| Polarization axial ratio at midband | 1.1 dB | Usefully circularly polarized. |
| 2 to 1 VSWR bandwidth at the electrical conductor 134 | 5.7% | Without the hybrid power divider connected. |
| VSWR bandwidth at hybrid power divider | <1.4 to 1 VSWR over 90% bandwidth | The hybrid power divider sends antenna reflections into a reject load ensuring low VSWR at all times. |
| 3 dB gain bandwidth | 8.9% | Gain bandwidth may be further increased by: 1) increased spacing between drive plate 104 and the ground plane plate 102, (2) increased passband ripple adjustments. |

TABLE 3

Comparison Of Table 1 Disk Antenna with Conventional Axial Mode Helix Antenna

| Parameter | Table 1 Disk Antenna 100 | Conventional Axial Mode Helix |
|---|---|---|
| Antenna length | 3.0λ | 4.68λ |
| Realized Gain | 15.8 dBi | 15.8 dBi |
| Electrical mode | Surface wave fields | Traveling wave currents |

Table 3 shows that the disk antenna of Table 1 operates at substantially reduced size relative to the axial mode helix antenna, while providing a similar level of realized gain. Further, the disk antenna of Table 1 offers the designer multiple different polarization options, which the axial mode helix antenna cannot accomplish. The reason for the increased gain for size of the disk antenna 100 may be the surface wave mode of operation employed. Traveling wave antennas such as the helix may make less efficient use of antenna size than do surface wave antennas. Traveling wave antennas have a slow build of waves due to the need for a grazing radiating structure/current flow. Surface wave antennas are not so limited, as for instance the disks of the present disk antenna 100 operate at right angles to the radiating wave.

The number of electrically active plates 108 included in a particular implementation of the disk antenna 100 may vary. Fewer electrically active plates 108 will reduce the gain of disk antenna 100 and more electrically active plates will increase the gain of the disk antenna 100. Selecting a diameter of the electrically active plate 108 of 0.327λ throughout and a spacing between adjacent ones of the electrically active plates 108 to be 0.19λ throughout, results in a convenient design implementation. In such a scenario, removal or addition of the electrically active plates may be done for easy trading of gain and beamwidth, and the adding or removing an electrically active plate 108 does not require redesign or re-trimming of disk antenna 100. Further, the described configuration will offer good sidelobe performance wherein antenna first sidelobe gain is reduced by approximately 13 dB relative to the main antenna beam.

As noted herein, the antenna can be implemented with or without conductive electrical contact between a center mast 106 formed of a conductive material and any one or all of the ground plane plate 102, the drive plate 104, and plurality of electrically active plates 108. When conductive electrical contact is made between a center mast 106 formed of a conductive material and any one or all of the ground plane plate 102, the drive plate 104, and plurality of electrically active plates 108 plate dimensions are modified to maintain electrical outcome.

Figure 12:
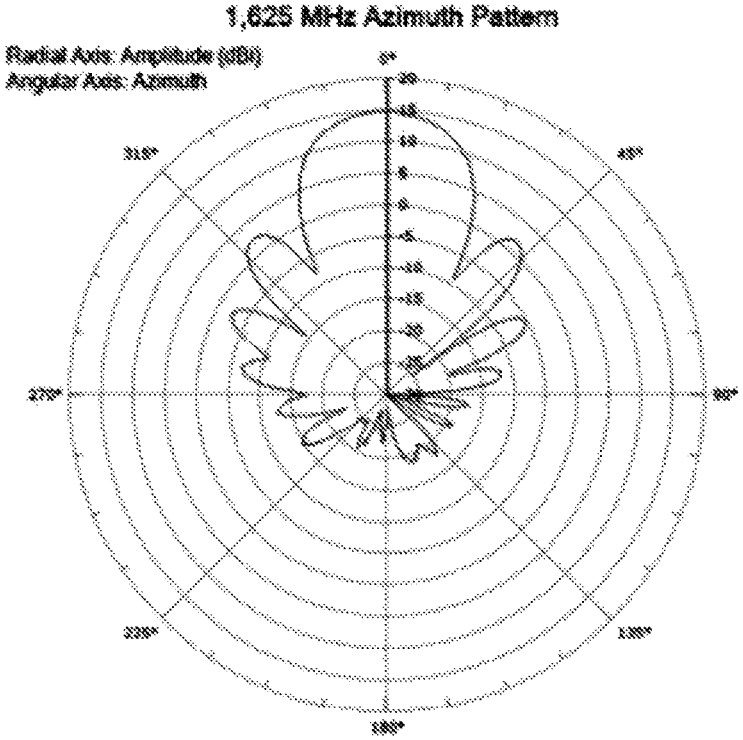
FIG. 12 is a far field radiation pattern of the example antenna described in Table 1.

FIG. 12 is a plot which depicts a measured far field radiation pattern of the Table 1 embodiment of the antenna 100. The measured quantity is realized gain as a function of look angle off the antenna axis. The realized gain units are in decibels with respect to isotropic for circular polarization. The FIG. 12 measurement included all the effects of impedance match, copper loss, cable loss, and hybrid power divider loss, etc. Peak realized gain was 15.8 dBi right hand circular polarization on the axis of the disk antenna 100. First sidelobe level was 13 dB down from the main lobe, which is consistent with the maximum gain "Hansen Woodward Condition", as described in the paper: Hansen, W. W., and J. R. Woodward, "A New Principle In Directional Antenna Design", March 1938, Proceeding of The Institute Of Radio Engineers (IRE) 26, pp 333-345.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Although the systems and methods have been illustrated and described with respect to one or more implementations, equivalent alterations and modifications will occur to others skilled in the art upon the reading and understanding of this specification and the annexed drawings. In addition, while a particular feature may have been disclosed with respect to only one of several implementations, such feature may be combined with one or more other features of the other implementations as may be desired and advantageous for any given or particular application. Thus, the breadth and scope of the disclosure herein should not be limited by any of the above descriptions. Rather, the scope of the invention should be defined in accordance with the following claims and their equivalents.

I claim:

1. A disk antenna comprising:

a plurality of plates forming a stack aligned along a principal axis, each plate comprising a major conductive surface extending in directions transverse to the principal axis;

the plurality of plates including a ground plane plate;

a plurality of electrically active plates; and a drive plate disposed between the ground plane plate and the plurality of electrically active plates; and a mast configured to transition from a first condition in which the mast is compactly stowed, to a second condition in which the mast is deployed such that a length of the mast along the principal axis is increased as compared to the first condition; and one or more suspension members configured to directly or indirectly couple the mast to the plurality of electrically active plates;

wherein the plates are configured to be compactly stacked when the mast is in the first condition, and are urged by the suspension members to a plurality of distributed locations along the length of the mast in the second condition.

2. The disk antenna of claim 1, wherein the drive plate is an antenna feed configured to couple radio frequency (RF) energy between the disk antenna and an RF transmission line.

3. The disk antenna of claim 1, wherein the mast is comprised of one or more elements selected from the group consisting of a spoolable extensible member (SEM), and a plurality of telescoping sections.

4. The disk antenna of claim 1, wherein the one or more suspension members are flexible tensile members secured at a first end to a carrier plate disposed at a tip end of the mast, distal from the ground plate.

5. The disk antenna of claim 4, wherein the one or more flexible tensile members are configured to determine the plurality of distributed locations of the plates when the mast is in the second condition.

6. The disk antenna of claim 1, wherein the plurality of electrically active plates have a shape selected from the group consisting of a polygon and a closed curved shape.

7. The disk antenna of claim 1, wherein a spacing between adjacent ones of the electrically active plates when the mast is in the second condition is varied along the principal axis in a direction from the ground plane plate to a radiating end of the mast distal from the ground plane plate.

8. The disk antenna of claim 1, wherein the plurality of electrically active plates have a circular profile and a diameter of the electrically active plates is varied in a direction along the principal axis from the ground plane plate to a radiating end of the mast distal from the ground plane plate.

9. The disk antenna of claim 1, wherein a spacing between adjacent ones of the electrically active plates when the mast is in the second condition is 0.2λ, where λ is a wavelength of a design frequency at which the disk antenna is to operate.

10. The disk antenna of claim 1, wherein the ground plane plate is comprised of two conductive ground plane layers, spaced apart by a predetermined distance by one or more inner conductive elements which electrically connect the two or more conductive ground plane layers to define an RF trap.

11. The disk antenna of claim 1, wherein the mast is comprised of a material selected from the group consisting of a highly conductive material and a low-loss dielectric material.

12. The disk antenna of claim 1, wherein at least one of the ground plane plate, the plurality of electrically active plates, and the drive plate includes a principal aperture through which the mast extends when the mast is in the second condition.

13. The disk antenna of claim 12, wherein one of more of the ground plane plate, the plurality of electrically active plates, and the drive plate are conductively isolated from the mast.

14. A method for deploying a disk antenna comprising:

arranging a plurality of plates to form a stack aligned along a principal axis, each plate comprising a major conductive surface extending in directions transverse to the principal axis;

ordering the plurality of plates in the stack to include a drive plate disposed between a ground plane plate and a plurality of electrically active plates;

controlling deployment of the disk antenna by transitioning a mast from a first condition in which the mast is compactly stowed, to a second condition in which a length of the mast along the principal axis is increased as compared to the first condition; and using one or more suspension members which are directly or indirectly coupled to the mast to urge the plurality of electrically active plates, in response to the transitioning, from a stowed configuration in which the plates are compactly stacked, to a deployed configuration in which a spacing between adjacent ones of the electrically active plates is increased, whereby the electrically active plates are distributed at predetermined spaced apart locations along an elongated length of the mast in the second condition.

15. The method of claim 14, further comprising using the drive plate as an antenna feed to couple radio frequency (RF) energy between the disk antenna and an RF transmission line.

16. The method of claim 12, further comprising selecting the mast to include one or more elements from the group consisting of a spoolable extensible member (SEM), and a plurality of telescoping sections.

17. The method of claim 14, wherein the one or more suspension members are selected to comprise flexible tensile members and the method further comprising securing the one or more suspension members at a first end to a carrier plate disposed at a tip end of the mast, distal from the ground plate.

18. The method of claim 17, further comprising securing the electrically active plates to the one or more flexible tensile members to control the locations of the electrically active plates along the length of the mast when the mast is in the second condition.

19. The method of claim 14, further comprising selecting the plurality of electrically active plates to have an outer peripheral shape selected from the group consisting of a polygon and a closed curved shape.

20. The method of claim 14, further comprising selecting the spacing between adjacent ones of the electrically active plates so that when the mast is in the second condition the spacing are varied along the principal axis in a direction from the ground plane plate to a tip end of the mast distal from the ground plane plate.

21. The method of claim 14, further comprising selecting the spacing between adjacent ones of the electrically active plates so that when the mast is in the second condition each electrically active plate is spaced 0.2λ from an adjacent electrically active plate, where λ is a wavelength of a design frequency at which the disk antenna is to operate.

22. The method of claim 14, providing an RF trap by forming the ground plane plate of two conductive ground plane layers, and spacing the two ground plane layers apart a predetermined distance using one or more inner conductive elements which electrically connect the two or more conductive ground plane layers.

23. The method of claim 14, forming the mast of a material selected from the group consisting of a highly conductive material and a low-loss dielectric material.

24. The method of claim 14, further comprising extending the mast through a principal aperture defined in at least one of the ground plane plate, the plurality of electrically active plates, and the drive plate.

25. The method of claim 24, further comprising conductively isolating from the mast one of more of the ground plane plate, the plurality of electrically active plates, and the drive plate.

* * * * *